United States Patent [19]

Rathjen

[11] 4,355,813

[45] Oct. 26, 1982

[54] PLAYING FIELD LAYOUT

[76] Inventor: Daniel J. Rathjen, 5112 N. Fairmount St., Davenport, Iowa 52806

[21] Appl. No.: 291,707

[22] Filed: Aug. 10, 1981

[51] Int. Cl.[3] ..... A63C 19/02

[52] U.S. Cl. ..... 273/411; 273/342

[58] Field of Search ..... 273/411, 342, 424; 272/3

[56] References Cited

U.S. PATENT DOCUMENTS 2,163,456 6/1939 Youngberg ..... 273/342

3,580,578 5/1971 McCarthy ..... 273/342

OTHER PUBLICATIONS

*Washington Post,* Mar. 30, 1979, p. 41, "A Flick of the Wrist and the Sport Flies".

*Primary Examiner*—William H. Grieb

*Attorney, Agent, or Firm*—Henderson & Sturm

[57] ABSTRACT

The disclosure relates to a playing field layout for playing a game with a throwable object of saucer-like characteristics, such as the well-known "Frisbee". The layout comprises a rectangular field divided across its short dimension by a skip court midway between the end lines. This skip court is of hardened material compared to the rest of the field and is of such nature as to cause the thrown object to bounce or skip to the player at the opposite side of the skip court. This player catches the object and throws it back, again skipping it from the skip court. To facilitate skipping, the skip court has its opposite edges that are parallel to the end lines formed as ramps that slope up to the top flat surface of the skip court. The remainder of the field may be of any suitable type, such as lawn, clay, etc.

3 Claims, 2 Drawing Figures

14
18
26
24
28
22
20
2
16
12
10

20
16
10

PLAYING FIELD LAYOUT

BACKGROUND OF THE INVENTION

The throwing and catching of Frisbees and like objects on fields, beaches, etc., has been known for many years. Some players develop tremendous skill in their ability to throw the object, being able to throw from various positions. Unknown at the present is any form of easily understood game in which players may participate according to rules and on a court or area laid out especially for such game. It is a feature of the present invention to provide such a playing field layout and one in which players of unlike skills can compete to their satisfaction and enjoyment. The significant feature of the invention is the skip court which is a hard-surfaced area disposed midway between the end lines of a rectangular field. The game involves the skipping of the object by one player off of the skip court to the player at the other end of the field, who catches the object and returns it, again skipping the object off the skip court. The areas at opposite ends of the field may be provided as one or more serving areas and these may include specially designated service circles. Also, the field may be divided lengthwise. Further, out-of-bounds areas may be provided, bordering the skip court along its opposite edges. Furthermore, these edges of the skip court are preferably formed as ramps leading uphill to the top, skipping surface of the skip court. Further features and objects will appear as the disclosure is made in detail.

DETAILED DESCRIPTION OF A PREFERRED EMBODIMENT

Figure 1:
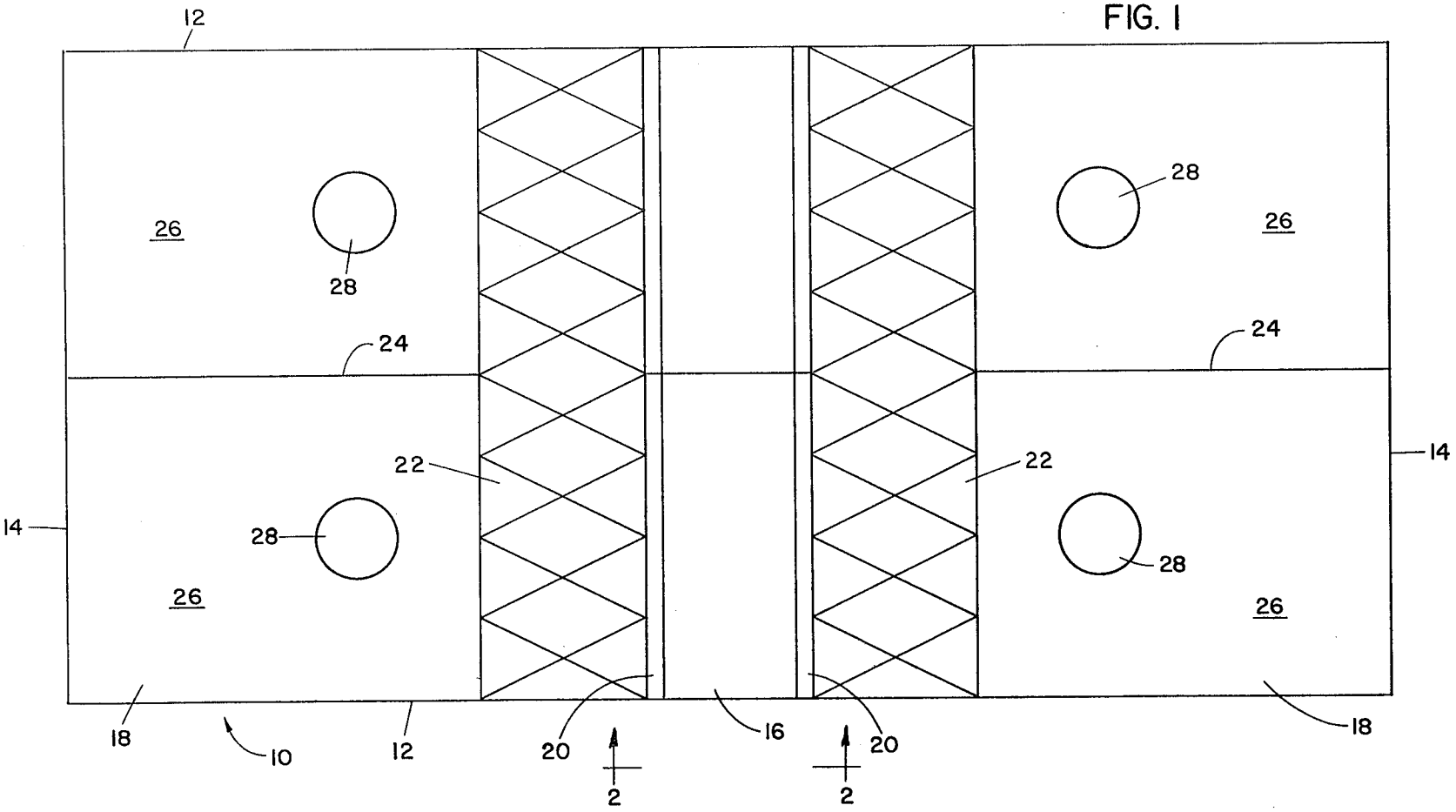
FIG. 1 is a plan of the layout.
Figure 2:
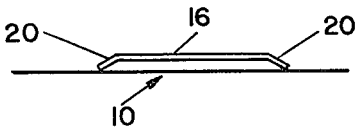
FIG. 2 is an end elevation of the skip court.

The playing field, designated in its entirety at 10, is rectangular, having two long sides 12 and two short sides or ends 14. The layout is designed primarily for out-of-doors use and thus should be of a suitable size, that shown being on the order of forty by eighty yards. The layout may have its sides and ends marked or drawn in any known manner, such as that used in laying out football, baseball, etc., fields. The field is divided midway between its end lines 14 by a skip court 16 which extends across from one side line to the other. On the basis of the above dimensions, it is preferred that this skip court have a width of about ten yards as measured lengthwise of the main area. Also, if the field is laid out on grass, clay, etc., the skip court should be of relatively hard-surfaced material, such as plywood, plastic, sheet metal or any suitable equivalent. The purpose of so providing the skip court in this fashion is that the game is played by two players, one in each of two like service areas 18, taking turns throwing and catching a saucer-like object such as the well-known Frisbee. In the playing of the game, the player serving the Frisbee initially must do so in such manner as to cause it to skip or bounce off the skip court into the opposite area 18, and the other player must catch the Frisbee cleanly in one hand and return it at his option either causing it to pass over, or to skip off, the skip court.

To facilitate the skipping of the Frisbee off the skip court, its opposite edges are provided as ramps 20 that lead uphill to the flat top surface of the skip court. This will enable placement of the skip court at a level above that of the main areas (for example, six inches) such that the skip surface will be clearly visible and fully playable. For example, if the layout is used on a grassy area, the likelihood of grass overhanging the ramps is minimized.

In the present layout, two out-of-bounds areas 22 are provided, one along each ramp 20. The rules may provide certain penalties for a player stepping into one of these areas, the Frisbee landing therein, and the like. In the preferred layout, each such area extends completely across the field and is on the order of 10 yards deep. This means that each service area is twenty-five by forty yards in size. Further, the field may be divided lengthwise by a center line 24 through each area 18, thus subdividing each area 18 into two smaller and equal sub-areas 26. Still further, designated service circles 28 may be provided from which a player must serve. Each circle is shown as being five yards in diameter and is located five yards back of the adjacent out-of-bounds area and about seven and one-half yards in from the adjacent sideline.

The rules for playing the game may vary. Those preferred are based in part on present types of one-on-one Frisbee. A preferred Frisbee is a "Master", weighing one hundred sixty-five grams and manufactured by the Whammo Company. It will have a diameter of five and seven-sixteenths inches and a height of one and three-eighth inches. The Frisbee may be thrown in any fashion except upside-down. The game is started by the toss of a coin determining the server and the end of the field he will defend. Points are scored only by catching the thrown and skipped Frisbee cleanly and in one hand; although variations may be introduced, such as awarding or deducting points for stepping out of bounds, etc. The so-called five-second rule requires that the Frisbee be returned within five seconds after it is touched. The rules may also provide that no player may use the same type of catch twice in sucession. A player must serve from his circle 28 and must throw diagonally across the field. A serve occurs only after some fault, such as the Frisbee going out of bounds, etc. To win, a player must score twenty-one points and have a winning margin of two points. These rules of course may be varied. Those set forth have been found to provide a reasonably strenuous and amusing game. Obviously, variations may be made in the dimensions of the layout and its parts, as may other modifications in the design within the spirit and scope of the invention.

I claim:

1. A playing field layout for use in playing a game involving the throwing back and forth by at least two players of a lightweight saucer-like object of the type commonly known as a "Frisbee", comprising a rectangular main court having opposite sides and opposite ends defining side and end boundaries, respectively, a relatively narrow skip court extending from one side of the main court to the other midway between the ends of the main court and dividing the main court into opposite serving and catching areas of equal area, each of said areas being greater than that of the skip court and each such area accommodating at least one player, said skip court having a flat top surface composed of hard material from which the object can skip when thrown by a player in one serving and catching area to a player in the other serving and catching area, said skip court further having opposite edge portions parallel to each other and to the ends of the main court, said portions being in the form of ramps leading uphill from the respective service and catching areas to the top surface of the skip court.

2. A playing field layout for use in playing a game involving the throwing back and forth by at least two players of a lightweight saucer-like object of the type commonly known as a "Frisbee", comprising a rectangular main court having opposite sides and opposite ends defining side and end boundaries, respectively, a relatively narrow skip court extending from one side of the main court to the other midway between the ends of the main court and dividing the main court into opposite serving and catching areas of equal area, each of said areas being greater than that of the skip court and each such area accommodating at least one player, said skip court having a flat top surface composed of hard material from which the object can skip when thrown by a player in one serving and catching area to a player in the other serving and catching area, said skip court further having opposite edge portions parallel to each other and to the ends of the main court, and a pair of out-of-bounds areas are provided, one along each edge portion of the skip court and separating said edge portion from the adjacent serving and catching area.

3. A playing field layout as in claim 2, in which each service area is divided midway between the sides of the main court by a line dividing each serving and catching area into two sub-areas.

* * * * *